US005615443A

United States Patent [19]

Lai

[11] Patent Number: 5,615,443

[45] Date of Patent: Apr. 1, 1997

[54] TOOTHBRUSH

[76] Inventor: Shyh-Jen Lai, 1F, No. 4, Lane 95, Kuling Street, Taipei, Taiwan

[21] Appl. No.: 625,296

[22] Filed: Apr. 1, 1996

[51] Int. Cl.[6] ..... A46B 9/04

[52] U.S. Cl. ..... 15/167.2; 15/145; 15/176.1; 601/141

[58] Field of Search ..... 15/167.2, 145, 15/176.1; 601/139–141; 606/234, 235

[56] References Cited

U.S. PATENT DOCUMENTS 3,109,192 11/1963 Levenson ..... 15/167.2
3,769,652 11/1973 Rainer ..... 15/167.2
5,175,901 1/1993 Rabinowitz ..... 15/167.2
5,337,436 8/1994 Saxer et al. ..... 601/139

*Primary Examiner*—Mark Spisich
*Attorney, Agent, or Firm*—Beveridge, DeGrandi, Weilacher & Young, L.L.P.

[57] ABSTRACT

A toothbrush which includes a brush head having an arched base made from flexible material, and a handle having two coupling rods respectively fastened to two transverse slots on the arched base, wherein the arched base of the brush head has two longitudinal grooves at two opposite lateral sides thereof respectively fitting the upper dental arch and the lower dental arch, and a plurality of bristles respectively installed in the longitudinal grooves.

2 Claims, 2 Drawing Sheets

TOOTHBRUSH

BACKGROUND OF THE INVENTION

The present invention relates to toothbrushes, and relates more particularly to such a toothbrush which is coupled to and moved between the upper dental arch and the lower dental arch to effectively clean the teeth.

Regular toothbrushes are commonly comprised of a handle having a bristle holder at one end, and bundles of bristles installed in the bristle holder. This structure of toothbrush is inconvenient for use by an adult to clean the teeth of a baby or young child. When cleaning the back side of the teeth, the mouth shall have to be opened widely so that the bristles of the toothbrush can be inserted into the inside of the mouth and attached to the back side of the upper teeth or lower teeth. If to open the mouth widely, the muscles of the mouth will ache after a certain length of time. Even adults will feel uncomfortable when open the mouth widely for a certain length of time.

SUMMARY OF THE INVENTION

The present invention provides a toothbrush which eliminates the aforesaid problems. It is a main object of the present invention to provide a toothbrush which allows the user to bite the brush head lightly without opening the mouth widely when brushing. According to the preferred embodiment of the present invention, the toothbrush comprises a brush head having an arched base made from flexible material, and a handle having two coupling rods respectively fastened to two transverse slots on the arched base, wherein the arched base of the brush head has two longitudinal grooves at two opposite lateral sides thereof respectively fitting the upper dental arch and the lower dental arch, and a plurality of bristles respectively installed in the longitudinal grooves.

DETAILED DESCRIPTION OF THE PREFERRED EMBODIMENT

Figure 1:
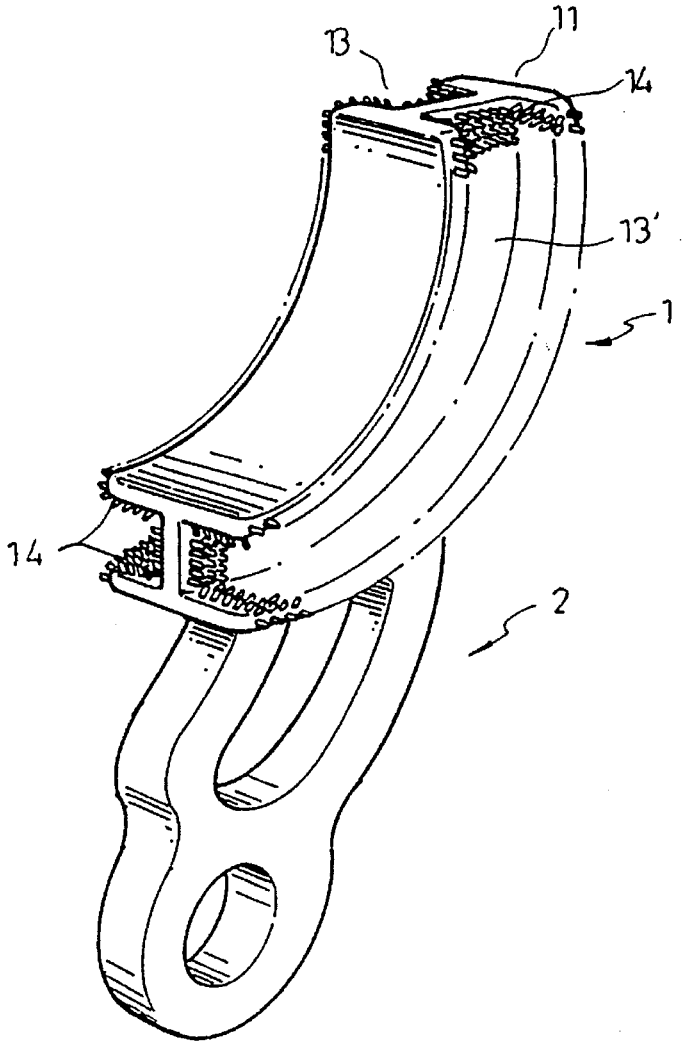
FIG. 1 is an elevational view of a toothbrush according to the present invention.

Referring to FIG. 1, a toothbrush in accordance with the present invention is generally comprised of a brush head 1, and a handle 2. The brush head 1 is comprised of an arched base 11 made from flexible material.

Figure 2:
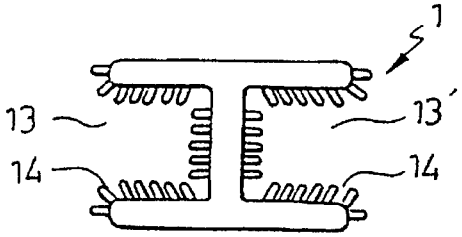
FIG. 2 is a cross section of the brush head of the toothbrush shown in FIG. 1.
Figure 3:
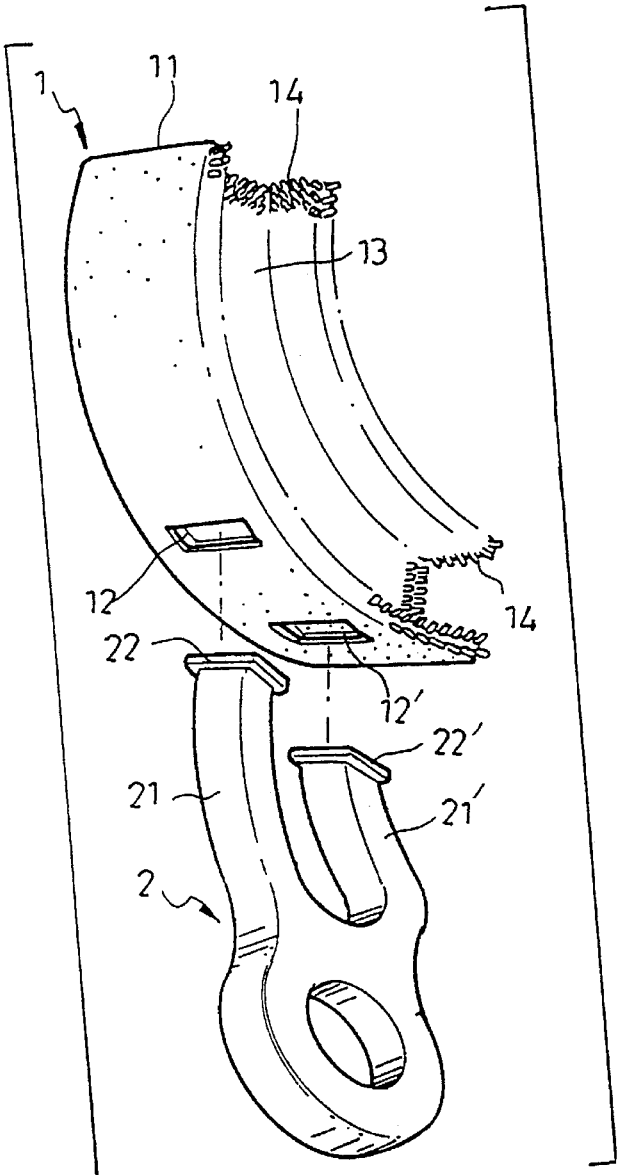
FIG. 3 shows the handle disconnected from the brush head according to the present invention.

Referring to FIGS. 2 and 3, the arched base 11 of the brush head 1 comprises two longitudinal grooves 13, 13' at two opposite lateral sides, and two transverse slots 12, 12' at the bottom side. Bristles 14 are respectively installed in the longitudinal grooves 13, 13'. The handle 2 has two coupling rods 21, 21' for coupling to the transverse slots 12, 12' of the brush head 1.

Figure 4:
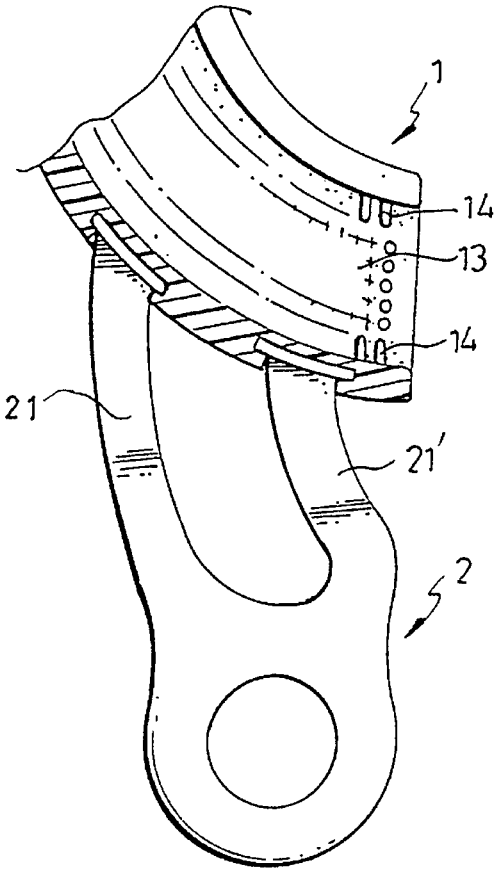
FIG. 4 shows the handle fastened to the brush head according to the present invention.

Referring to FIG. 4 and FIG. 3 again, the coupling rods 21, 21' are springy, having a respective outward flange 22, 22' at the end. By forcing the coupling rods 21, 21' into the transverse slots 12, 12', the handle 2 is fixed to the arched base 11 of the brush head 1.

Figure 5:
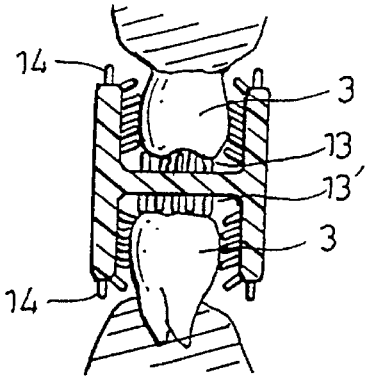
FIG. 5 is an applied view of the present invention, showing the brush head coupled to the teeth and moved.

Referring to FIG. 5, when in use, the arched base 11 of the brush head 1 is inserted into the mouth to force the longitudinal grooves 13, 13' of the arched base 11 into engagement with the two series of teeth 3. When the arched base 11 of the brush head 1 is moved by hand through the handle 2 relative to the teeth 3, the bristles 14 rub against the teeth 3, and therefore the teeth 3 are cleaned.

Further, the handle 2 is preferably molded from thermoplastic so that it can be deformed by heating and then bent to the desired angle relative to the arched base 11 of the brush head 1 subject to the curvature of the individual dental arch.

While only one embodiment of the present invention has been shown and described, it will be understood that various modifications and changes could be made without departing from the spirit and scope of the invention disclosed.

What the invention claimed is:

1. A tooth brush, comprising:

a half U-shaped brush head; and a handle connected to said half U-shaped brush head, wherein, said half U-shaped brush head includes an arched flexible base and a plurality of bristles, wherein, said arched flexible base includes two longitudinal grooves provided in opposition for respectively fitting an upper dental arch and a lower dental arch and two transverse slots at a bottom side thereof, wherein, said plurality of bristles are installed in said two longitudinal grooves, and wherein, said handle has two coupling rods, said two coupling rods being springy and each having a flange on a terminal end, said flange of each of said two coupling rods respectively being removably plugged into said two transverse slots of said arched flexible base.

2. A toothbrush as defined in claim 1, wherein:

an angle of said handle relative to said base is variable to a desired angle.

* * * * *